United States Patent [19]

Pozar

[11] 4,242,937

[45] Jan. 6, 1981

[54] PICKUP ASSEMBLY FOR PERCUSSION INSTRUMENT

[76] Inventor: Cleve F. Pozar, 125 Green St., Cambridge, Mass. 02139

[21] Appl. No.: 10,226

[22] Filed: Feb. 8, 1979

Related U.S. Application Data

[63] Continuation-in-part of Ser. No. 857,180, Dec. 2, 1977, abandoned.

[51] Int. Cl.[3] ..... G10D 13/02

[52] U.S. Cl. ..... 84/1.15; 84/DIG. 12; 84/411 R

[58] Field of Search ..... 84/1.15, 1.14, DIG. 12, 84/411 R; 179/1 M, 138 R; 181/151, 290

[56] References Cited

U.S. PATENT DOCUMENTS

| | | | |
|---|---|---|---|
| 2,573,254 | 10/1951 | Fender | 84/1.15 |
| 3,509,264 | 4/1970 | Green | 84/1.15 |
| 3,553,339 | 1/1971 | Dominguez | 84/1.15 |
| 3,611,653 | 4/1970 | Zinn | 181/290 |
| 3,720,285 | 3/1973 | Russell | 181/151 |
| 3,725,561 | 4/1973 | Paul | 84/1.15 |

*Primary Examiner*—J. V. Truhe
*Assistant Examiner*—Forester W. Isen
*Attorney, Agent, or Firm*—Wolf, Greenfield & Sacks

[57] ABSTRACT

A magnetic pickup assembly is mounted from a support member bridging across the drum housing. The support member preferably extends diametrically across the drum housing and has slot means or the like permitting the mounting of the pickup assembly at different positions along a radial locus of the drum housing. In a preferred version the support member is of laminated construction to reduce vibration. The pickup assembly, in addition to comprising a pickup coil also comprises a series of ferromagnetic members secured to the drum diaphragm and also disposed spacedly along the radial locus of the housing; the arrangement wherein the pickup coil is adjustable to one of a number of different positions for obtaining different tonal outputs from the instrument.

19 Claims, 11 Drawing Figures

PICKUP ASSEMBLY FOR PERCUSSION INSTRUMENT

RELATED APPLICATION

This is a continuation in part of application Ser. No. 857,180 filed Dec. 2, 1977, now abandoned.

BACKGROUND AND SUMMARY OF THE INVENTION

The present invention pertains to a pickup for use with a percussion instrument such as a conventional snare drum or any other type of drum instrument. Furthermore, the principles of this invention may be used with other percussion instruments such as a roto tom. This invention also pertains to a pickup assembly and associated support member therefor to provide positioning of the pickup at one of a number of different positions along a radius of the drum.

U.S. Pat. No. 3,553,339 shows a pickup arrangement for a drum musical instrument. This prior art structure has certain disadvantages associated therewith. For example, the pickup assembly is essentially limited to one position in the drum structure. Thus, there is not sufficient adjustability of the pickup assembly relative to the drum diaphragm. Also, in this prior art patent they are attempting to simulate the sounds of an actual drum; whereas, the present invention is used in association with an actual drum construction for providing amplification and tone control. In accordance with the present invention it has been found that it is quite desirable to provide for a change in tone color by providing for the positioning of the pickup at one of a number of different positions along a radius of the drum diaphragm. In this way now the pickup assembly can be positioned so as to provide the desired tone output having more or fewer harmonics.

Accordingly, one object of the present invention is to provide an improved pickup for a percussion instrument and which is adjustable to one of a number of different positions for obtaining different tonal outputs from the pickup.

Another object of the present invention is to provide a pickup assembly comprising preferably a single pickup coil and a plurality of spaced ferromagnetic members radially disposed on the inner surface of the diaphragm of the percussion instrument.

Another object of the present invention is to provide a support member for the pickup assembly that is readily adapted for insertion in an existing drum housing and that may be constructed either in a single piece or in two pieces, which in either case is easy to install in the drum.

Still another object of the present invention is to provide a support member for the pickup assembly that is preferably laminated to reduce vibration in the instrument.

Still a further object of the present invention is to provide an improved pickup assembly for a percussion instrument that is relatively simple in construction, that is adjustable in two orthogonal directions, that requires little maintenance, and that can be installed quite easily.

To accomplish the foregoing and other objects of this invention there is provided an improved pickup for a percussion instrument. In the illustrative embodiments disclosed herein the invention is shown used in association with a conventional drum such as a snare drum, and also a roto tom. The pickup apparatus of this invention comprises a pickup means disposed within the instrument, a plurality of ferromagnetic members secured to the diaphragm of the instrument and spacedly disposed along a locus extending from the center of the diaphragm to the edge thereof, and means for mounting the pickup means facing the ferromagnetic members in any one of a number of different positions, each aligned with one of the ferromagnetic members. The pickup means preferably comprises a magnetic pickup coil and a support means which in the disclosed embodiment is a threaded support rod. Each of the ferromagnetic members preferably comprises a circular ferromagnetic metal foil such as steel or iron shim stock. Each of the ferromagnetic members are spacedly disposed preferably along a radius of the diaphragm. The support for the magnetic pickup coil permits adjustment of the coil toward and away from the ferromagnetic member with which it is aligned. There is also included locking means for the pickup support so as to lock the pickup in any one of a number of different positions once it has been aligned with the desired ferromagnetic member. The mounting means for the pickup preferably comprises an elongated support rod or bar extending between opposite walls of the percussion instrument. This support member is preferably slotted to receive the support rod of the magnetic pickup coil. In accordance with one embodiment of the invention the support member is preferably provided in two separate pieces which are connected together within the instrument. This two piece construction of the rod is important in that because of the particular construction of the instrument, it may be difficult to insert a single piece support rod. The two piece support rod may be disconnected or loosened and quite easily fitted in the instrument. Thereafter, once in place, the two pieces can be connected to provide an integral support rod. This support rod preferably extends across a diameter of the instrument and permits adjustment of the pickup means along a radius of the instrument. In this way the pickup means can be aligned with different ones of the ferromagnetic members to provide different tonal qualities of sound reproduction.

In accordance with a preferred embodiment of the present invention the support member is of laminated construction including, for example, alternate laminations of a soft wood such as balsa wood and a resilient material such as urethane foam of medium density. The laminated support eliminates or at least drastically reduces any vibration that may occur in the instrument. Such vibration could cause the detection of erroneous frequency signals.

DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 5:
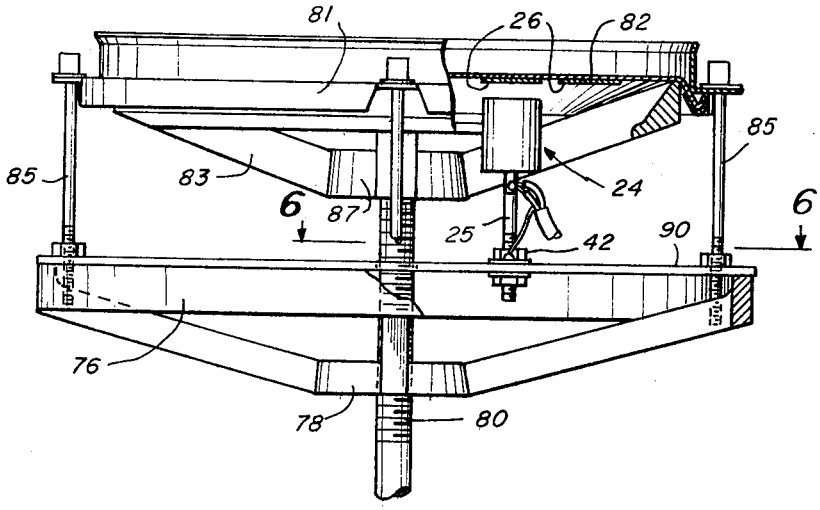
FIG. 5 is a front elevation view that is partially cut away showing pickup apparatus of this invention used with another type of percussion instrument.
Figure 6:
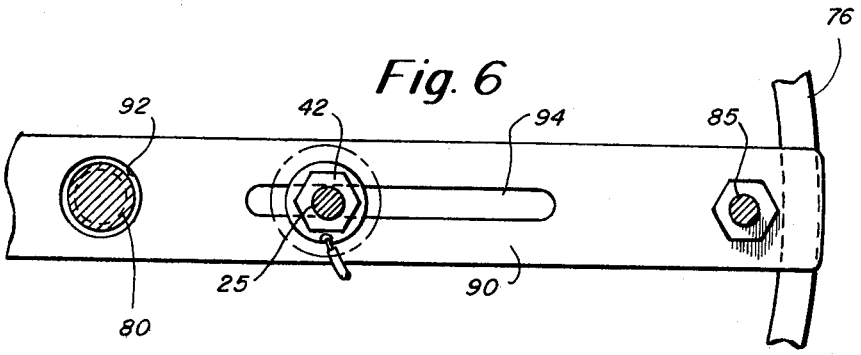
FIG. 6 is a fragmentary cross-sectional view taken along line 6—6 of FIg. 5.
Figure 7:
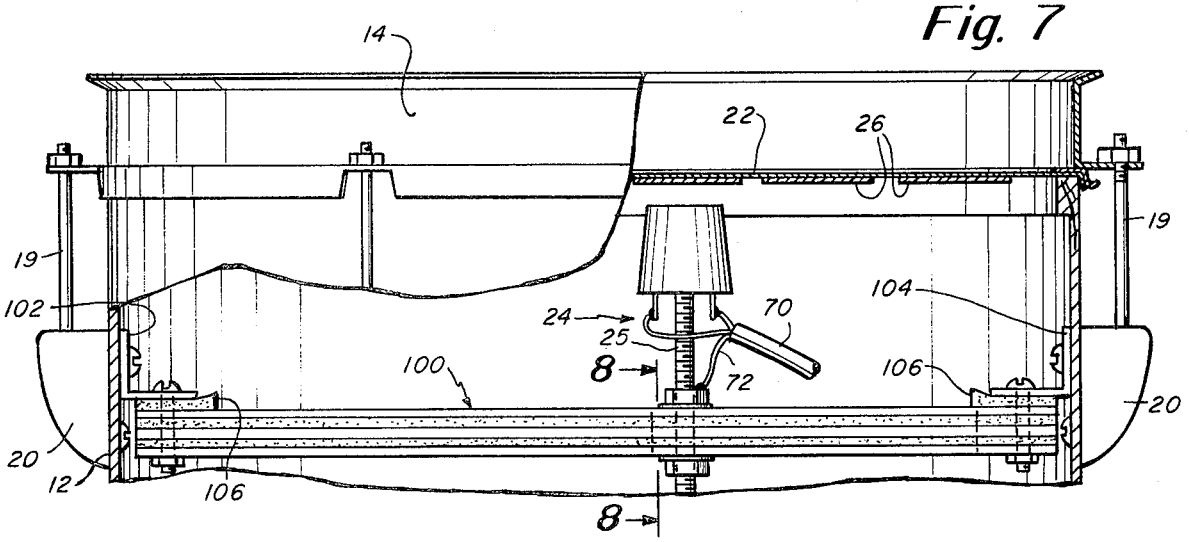
FIG. 7 shows a fragmentary view of a preferred embodiment of the present invention using a laminated support for the pickup assembly.
Figure 8:
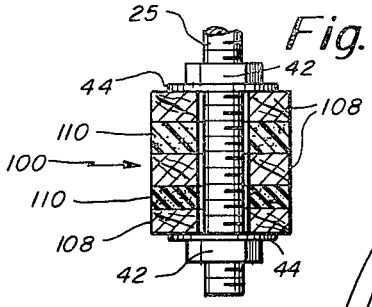
FIG. 8 is a cross-sectional view taken along line 8—8 of FIG. 7 showing the construction of the laminated support.
Figure 10:
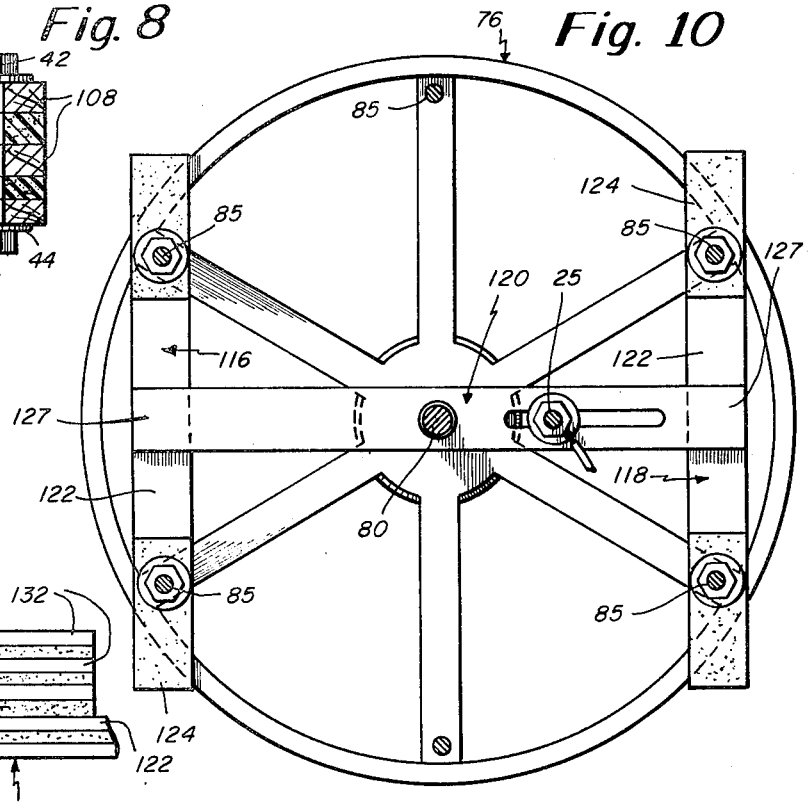
FIG. 10 is a cross-sectional view taken along line 10—10 of FIG. 9.
Figure 11:
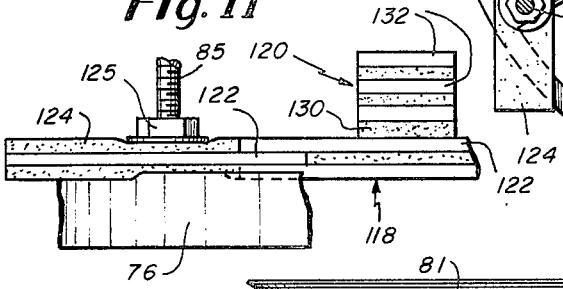
FIG. 11 is a further cross-sectional view as taken along line 11—11 of FIG. 9.
Figure 9:
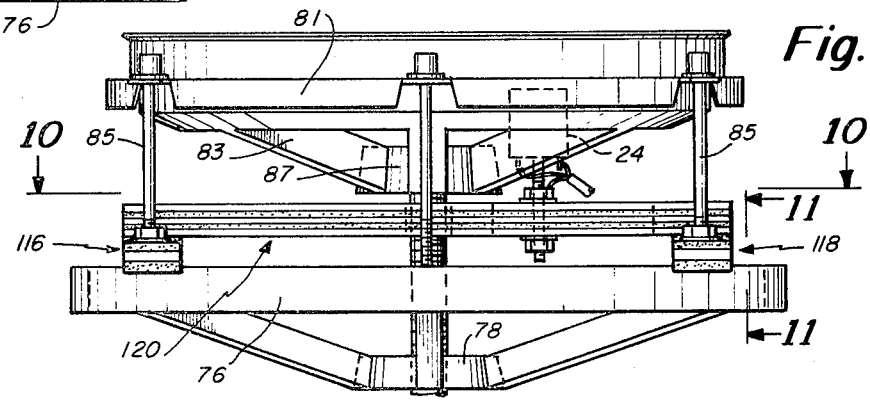
FIG. 9 is also a preferred embodiment as applied to a roto tom.

FIGS. 1-4 show one embodiment of the present invention that may be used with a conventional drum such as a snare drum. FIGS. 5 and 6 show the apparatus of this invention used with the different drum construction. FIGS. 7 and 8 show a drum construction like that previously shown in FIG. 1 using a laminated support for the pickup assembly. FIGS. 9-11 show a roto tom construction using the laminated support. The concepts of this invention may also be applied to percussion instruments of many different sizes including larger bass drums and smaller bongo-type drums.

In FIGS. 1-4 there is shown a drum 10 which comprises a cylindrical housing 12 usually constructed of wood. The drum shown in the first embodiment is substantially of conventional design also including a top frame 14, a bottom frame 16, and tensioning members 18, each of which comprises a rod 19 and holder 20.

In FIGS. 1-4 the drum diaphragm or head 22 is supported from the top frame 14 in a conventional manner with the tensioning member 18 being used for the purpose of tuning the diaphragm 22.

The pickup apparatus of the invention is shown in FIGS. 1-4 as comprising a pickup means 24, a plurality of ferromagnetic members 26, and a support bar which is comprised of support pieces 28 and 29.

Figure 1:
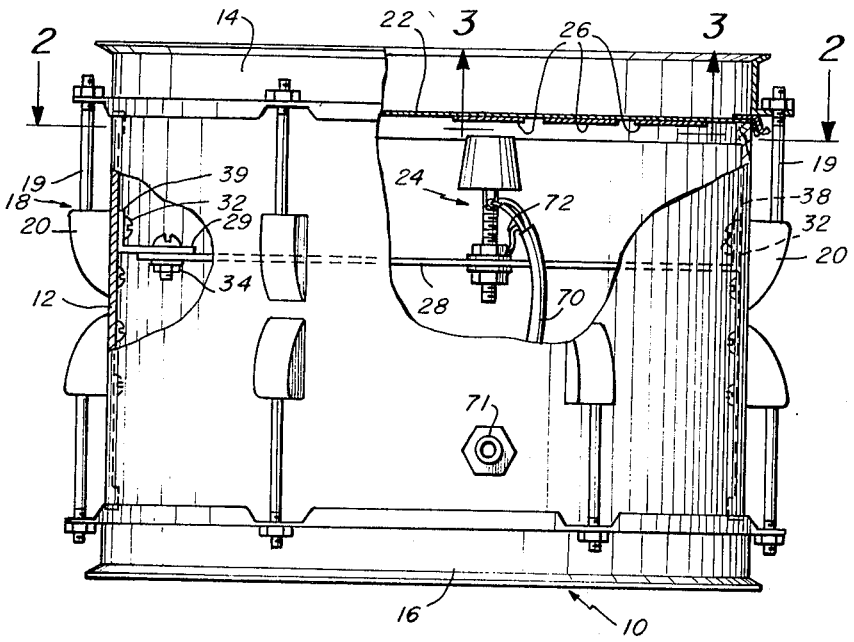
FIG. 1 is a front elevation view partially cut away to show the pickup apparatus of this invention.
Figure 2:
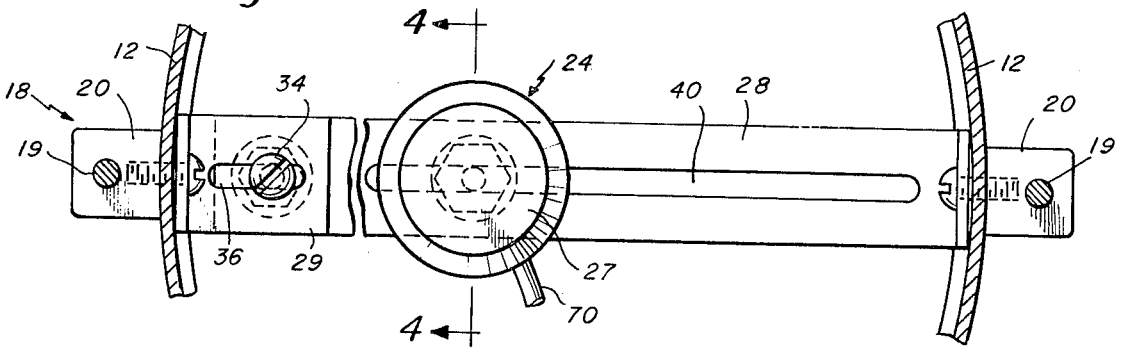
FIG. 2 is a cross-sectional view taken along line 2—2 of FIG. 1.
Figure 4:
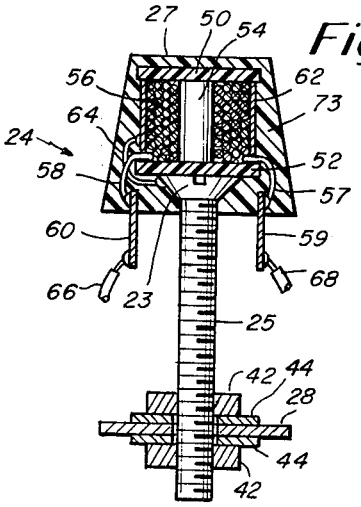
FIG. 4 is a cross-sectional view through the pickup means of this invention as taken along line 4—4 of FIG. 2.

FIG. 4 shows the detail of the pickup transducer of this invention which employs the bolt head 23 of bolt 25 as a primary means of support for the magnetic pickup coil. The pickup means or transducer of this invention comprises insulating disks 50 and 52, the bottom one of which is secured to the top of the head 23 such as being epoxy glued thereto. A permanent magnet 54 is then would with insulated magnetic wire 56 which may be 40 gauge Belden wire. The wire ends 57 and 58 connect respectively to terminal strips 59 and 60. In order to shield the coil of wire there is provided an aluminum foil layer 62 that may be wound in a number of layers about the previously wound wire 56. An additional connecting wire 64 couples from the layer 62 to the bolt head 23. Further wire sections 66 and 68 couple from the terminal strips 60 and 59, respectively. The wires 66 and 68 are shown in FIG. 1 as coupling by way of cable 70 to a standard connector jack 71. FIG. 1 also shows the common ground wire 72 which couples in the cable 70 and provides a ground from the pickup transducer. The connections to jack 71 can be made to an amplifier or to a mixer circuit not shown in the drawings.

The transducer shown in FIG. 4 is preferably constructed with a hard epoxy protective layer 73. This layer encapsulates the transducer. In order to provide this encapsulation a mold is used with the transducer actually being formed in the position inverted from FIG. 4.

Figure 3:
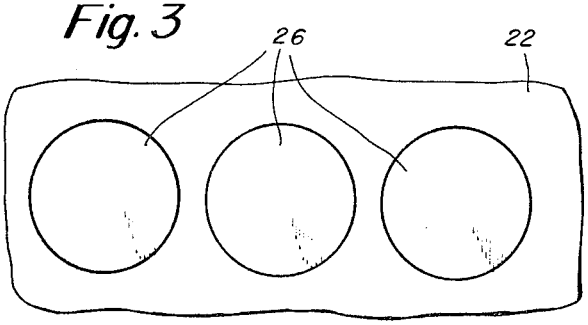
FIG. 3 is a further cross-sectional view taken toward the ferromagnetic members along line 3—3 of FIG. 1.

Each of the ferromagnetic members 26 preferably has a circular shape as depicted in FIG. 3 although it is also possible to provide members 26 that are square or rectangular or other shape. Preferably, the hed 27 of the transducer has a shape that will match the shape of the ferromagnetic members 26. Each of the members 26 may be constructed of very thin shim stock such as steel or iron shim stock in the thickness range of 0.0001 to 0.001 inch. A contact cement may be used for securing the members 26 to the inner surface of the diaphragm 22. It is desirable to use a contact cement that stays relatively tacky so that the members remain flexible on the diaphragm. In FIG. 3 the members 26 may have a diameter on the order of 1 inch while the spacing between adjacent members may be on the order of ¼ inch.

The support pieces 28 and 29 are secured with the use of the same bolts 32 that are used to secure the holders 22 to the housing 12 of the instrument. The bolt and nut arrangement 34 is used for coupling the contacting ends of the pieces 28 and 29. In this connection at least the piece 29 may be provided with a slot 36 to provide some adjustment to the overall length of the support bar. Each of the pieces 28 and 29 have turned ends 38 and 39, respectively, with holes therein for receiving the bolts 32 to support the entire support bar from the inner surface of the drum housing.

The support piece 28 has an elongated slot 40 having a length substantially the same as the length spanned by the ferromagnetic members 26. The support rod 25 is adapted to fit within the slot 40 and may be locked in any position by means of the locking nuts 42 and associated washers 44. By loosening the nuts 42 the pickup means 24 may be adjusted to provide different spacings between the head 27 and the ferromagnetic member 26 with which the pickup is aligned. Furthermore, by loosening the nuts 42 the rod 25 may be moved along the elongated slot 40 so that the pickup means may align with other ones of the ferromagnetic members 26.

FIGS. 5 and 6 show a different type of drum instrument commonly referred to as a roto tom. FIGS. 5 and 6 show the pickup apparatus of this invention supported in this conventional drum structure. The drum comprises a lower fixed frame 76 having a center support base 78 that is internally threaded to receive the threaded support post 80. The post 80 may be supported from a conventional stand, such as the stand used for holding a cymbal. The drum of FIG. 5 also has an upper frame 81, for supporting the diaphragm 82, a moveable frame 83, and a plurality of support rods 85, each interconnecting between the upper and lower fixed frames.

Adjustable tension is provided on the diaphragm 82 by means of the moveable frame 83 so as to make the diaphragm either more or less taut. By screwing the threaded support post, the moveable frame 83 may be moved toward and away from the upper frame 81. The top end of the support post 80 fits within an aperture in the base 87 to provide this lifting action.

In the embodiment of FIGS. 5 and 6 the pickup means 24 may be substantially of the same construction as the pickup used in the first embodiment. Also, the ferromagnetic members 26 may be of the same construction as discussed with reference to the first embodiment. In FIG. 5 it is noted that there are only two such members. However, it is understood that additional members 26 may be provided depending upon the size of the instrument. Also, the locking means which comprises nuts 42 may be substantially the same as the one shown in the first embodiment.

The support bar 90 in this embodiment is a single piece bar of substantially flat stock having holes at the very ends thereof for receiving the support rods 85. The support bar 90 rests upon the outer periphery of the lower frame 76 as clearly indicated in FIG. 5. At the center of the bar 90 there is provided an aperture 92 having a diameter larger than the outside diameter of the threaded support post 80 so as to permit uninterfered operation between the bar 90 and the post 80. As the tension on the diaphragm 82 is changed there is relative movement between the bar 90 and the post 80. The elongated support bar 90 is also provided with an elongated slot 94 having a length substantially the same as the length defined by the pair of ferromagnetic members 26. The pickup means 24 is supported in the slot 94 in substantially the same manner as the pickup was supported in the first embodiment. By loosening the nuts 42 the pickup means may be moved so that it can align with either of the ferromagnetic members. Also, when the locking means is unlocked, the support post 25 may be adjusted along its length so as to adjust the spacing between the pickup means 24 and the associated ferromagnetic member.

FIGS. 7 and 8 show a preferred embodiment used with a conventional drum construction such as the one shown in FIGS. 1–4. In FIGS. 7 and 8 the same reference characters are used to identify like parts also shown in FIGS. 1–4. Thus, there is included in the construction a pickup means 24 which is of the same construction as shown in FIGS. 1 and 4. However, the pickup means is supported in an improved manner to reduce vibration by means of the laminated bar 100 which is supported at its ends from L-shaped brackets 102 and 104, which are both secured to opposite surfaces of the drum housing 12. Bolts extend through the horizontal legs of these brackets and also through the opposite ends of the laminated support member 100 as clearly depicted in FIG. 7. The member 100 has a like thickness through its length with the exception of the foam padding 106 between the member 100 at its ends and the respective horizontal legs of the brackets 102, 104.

FIG. 8 is a cross-sectional view through the member 100 shown in FIG. 7. The member 100 is laminated including wood layers 108 sandwiching therebetween foam layers 110. Each of these laminations may be of the same thickness or they may be of different thickness. The foam is preferably a medium density foam and the center foam layer may be of styrafoam.

FIGS. 9–11 show a further embodiment of the present invention in the form of a roto tom instrument substantially the same as the one shown and previously described in FIGS. 5 and 6. FIGS. 9–10 show an improved construction using laminated support for the pickup assembly 24. This laminated support includes a pair of side support members 116 and 118 and a center support member 120 bridging between members 116 and 118. The side members 116 and 118 may be of substantially the same construction having alternate laminations of wood 122 and foam 124. It is noted in this arrangement that laminations are staggered through the width of the member and also along the length as clearly depicted in FIGS. 10 and 11. It is preferred to have the foam 124 adjacent to the nut 125 and associated washer both associated with the post 85. It is noted that this arrangement also includes a lower foam layer contacting the member 76. At the connection points or areas 127 the side members 116 and 118 may be connected with the cross member 120 by being glued thereto. In this connection it is noted that there is a foam layer 130 of the member 120 that would be glued with a wood layer 122 of either member 116 or 118. The cross member 120 may be of a laminant similar to the laminant 100 shown in FIG. 7 including, in addition to multiple foam layers 130, multiple wood layers 132 depicted in FIG. 11.

In the center of the member 120 where the post 80 extends, the center hole in the member 120 should be oversized so that the post does not touch with the member 120. This is important in reducing any transfer of vibration from the frame to the support for the transducer assembly.

Having described a limited number of embodiments of this invention, it should now become apparent to those skilled in the art that numerous modifications can be made to these embodiments of the invention without departing from the scope of the invention. For example, for an instrument having two heads, it is possible to provide two pickup transducers, each positioned adjacent a corresponding head of the instrument. Also, it is possible to install two pickups on a single support bar. For example, in the embodiment of FIG. 1 another transducer could be disposed next to the transducer shown therein for alignment with an adjacent ferromagnetic member. Also, the ferromagnetic members are preferably constructed in a circular shape as depicted in FIG. 3. With this arrangement there is less likelihood of the edges of the the member lifting as might occur with a square arrangement. It has been found that with the square or rectangular arrangement, when the edges lift, there is a buzzing effect that is undesirable. However, although the circular shape is preferred, it is understood that the invention will cover substantially any shape or ferromagnetic member and shape of transducer.

What is claimed is:

1. A pickup apparatus for a percussion instrument that has a vibratable diaphragm, said apparatus comprising:

a single pickup means disposed within the instrument, a plurality of ferromagnetic members each including a thin foil and means for securing each foil directly to the undersurface of the diaphragm whereby said foils are spacedly disposed along a locus extending from the center of the diaphragm to the edge thereof, means for mounting said single pickup means within the instrument facing the ferromagnetic members in one of a plurality of positions aligned with one of said ferromagnetic members, said means for mounting comprising a support bar having a width substantially less than the diameter of the percussion instrument extending in a direction between opposite side walls of the percussion instrument and including a pickup means mounting section extending substantially parallel to the diaphragm and having a length at least sufficient to permit positioning of said single pickup means in alignment with any of said ferromagnetic members, said pickup means mounting section being at least as long as the width of two adjacent ferromagnetic members including the spacing therebetween, and means for releasably locking said single pickup means to the pickup means mounting section in a fixed position in alignment with one of the ferromagnetic members, said single pickup means being adjustable relative to the ferromagentic members to enable tone adjustment.

2. A pickup apparatus as set forth in claim 1 wherein said pickup means includes a magnetic pickup coil.

3. A pickup apparatus as set forth in claim 2 wherein said pickup means has an end area comparable to the area of the thin foil.

4. A pickup apparatus as set forth in claim 2 wherein each thin foil is circular and wherein the spacing between the edge of foils is less than the diameter of a foil.

5. A pickup apparatus as set forth in claim 1 wherein said ferromagnetic members extend along a radius locus.

6. A pickup apparatus as set forth in claim 1 including means for locking the pickup means in any one of a number of different positions relative to the spacing between the pickup means and aligned ferromagnetic member.

7. A pickup apparatus as set forth in claim 1 wherein said pickup means includes a magnetic pickup coil and a support rod, said support bar having a slot extending therealong for receiving the support rod of the pickup means to permit movement of the pickup means along the support bar to different positions in alignment with other ones of said ferromagnetic members.

8. A pickup apparatus as set forth in claim 1 wherein said support bar includes two support pieces connected together in the instrument.

9. A pickup apparatus as set forth in claim 1 wherein said percussion instrument is a drum and the support bar extends between opposite sides of the drum extending substantially parallel to the diaphragm along substantially its entire length.

10. A pickup apparatus as set forth in claim 1 wherein said percussion instrument is a drum and the support bar extends across the drum spaced above the base of the drum.

11. A pickup apparatus as set forth in claim 1 wherein the same means for locking is used to lock the pickup means in more than one position.

12. A pickup apparatus as set forth in claim 1 wherein said support bar comprises a laminated member.

13. A pickup apparatus as set forth in claim 12 wherein said laminated member comprises laminations of wood and a foam material.

14. A pickup apparatus as set forth in claim 12 including, in addition to the laminated support member, a pair of side support members that are also laminated and that support opposite ends of the main support member.

15. A pickup apparatus as set forth in claim 1 wherein the foils are adhesively secured to the diaphragm.

16. A pickup apparatus as set forth in claim 15 wherein each foil comprises a thin shim stock in the thickness range of 0.0001 to 0.001 inch.

17. A pickup apparatus as set forth in claim 1 wherein said means for securing each foil includes adhesive means.

18. A pickup apparatus as set forth in claim 17 wherein the adhesive means stays relatively tacky so that the foil remains flexible on the diaphragm.

19. A pickup apparatus as set forth in claim 1 wherein the pickup means is a single pickup common to all ferromagnetic members.

* * * * *